United States Patent [19]

Phillips

[11] 3,983,604

[45] Oct. 5, 1976

[54] IDENTIFICATION BAND CLIP

[75] Inventor: Thomas E. Phillips, Ingleside, Ill.

[73] Assignee: Baxter Laboratories, Inc., Morton Grove, Ill.

[22] Filed: Apr. 7, 1975

[21] Appl. No.: 565,935

[52] U.S. Cl. ..... 24/16 PB; 24/255 SL; 40/21 C; 225/84

[51] Int. Cl.[2] ..... B65D 63/00; B26F 3/02; G09F 3/12

[58] Field of Search ..... 40/21 C; 225/84; 292/307 R, 325; 24/206 A, 248 SL, 249 SL, 255 SL, 17 AP, 16 R, 16 PB, 30.5 P

[56] References Cited

UNITED STATES PATENTS

| | | | |
|---|---|---|---|
| 954,227 | 4/1910 | Thorne | 40/21 C |
| 3,034,189 | 5/1962 | Twentier | 24/16 PB UX |
| 3,713,622 | 1/1973 | Dinger | 24/255 SL X |
| 3,744,691 | 7/1973 | Shears | 40/21 C X |
| 3,800,450 | 4/1974 | Laugherty | 40/21 C |

*Primary Examiner*—Donald A. Griffin

*Attorney, Agent, or Firm*—Louis Altman; Garrettson Ellis

[57] ABSTRACT

An I. D. (identification) band clip adapted for use with a tape strip is herein disclosed. The clip has plastic upper and lower arms connected by a deformable hinge. A metal retaining clip of Z-shaped cross-section is positioned between the upper and lower arms. In use, a loop of tape strip has one end thereof fixedly held between the lower arm and the retaining clip, and the other end is fixedly held between the upper arm and the retaining clip.

6 Claims, 5 Drawing Figures

IDENTIFICATION BAND CLIP

BACKGROUND OF THE INVENTION

Identification bands for attachment to a patient's wrist have been in use for many years, particularly in hospitals and other medical institutions. The indentification bands are important since an incapacitated patient may not be able to identify himself, or give meaningful information about himself.

In particular, it may be important to have certain information directly attached to the patient, which cannot be removed by the patient. For example, information carried on the patient regarding his blood typing is important, since an error in cross-matching transfused blood may result in death.

Recently a new system involving direct coding of plastic tape strips used for identification bands has been patented as U.S. Pat. No. 3,698,383, issued to Baucom.

Also, U.S. Pat. No. 3,744,691, issued to Shears, discloses a type of I. D. (identification) band clip which may be employed in such a band.

The prior art clips, however, suffer from several disadvantages of manufacturing and clinical use. For example, the Shears clip is constructed of sheet metal, usually stainless steel, which comes in contact with the patient's limb, during use. Small children wearing an identification band having a metal clip, such as the Shears clip, may attempt to open the clip with a free hand or their teeth, and injure themselves in the process.

Also, the Shears clip holds the wrist band by friction between a flat, adhesive-coated sponge rubber pad, and the flat, smooth inner surface of the upper arm of the clip. It may be appreciated that a strong individual may be able to free the tape from the Shears clip by tugging on it, overcoming the shear strength of the adhesive.

In addition, if the pad has lost part of its adhesion due to long shelf life or other deterioration, it will not securely hold the tape strip. Thus, the tape strip could be freed, allowing removal of the identification band.

Metal clips are also inconvenient to use, since the metal hinges of the clips are often difficult to deform with mere finger pressure. Thus, a nurse may be forced to resort to pliers or the like to attach the identification band.

The invention of this application provides an identification band clip made chiefly of plastic and having a new, more reliable retention technique, thus reducing or eliminating the disadvantages recited above.

SUMMARY OF THE INVENTION

The present invention provides an I. D. band clip adapted for use with a plastic tape having a plastic lower arm, and a hinge formed integral therewith, connecting a plastic upper arm to the lower arm. A retaining member is positioned between the upper and lower arms for cooperating with the arms to grip a tape strip. In use, the tape strip has one portion fixedly retained between the lower arm and the retaining member, and another portion is fixedly retained between the upper arm and the retaining member.

Figure 1:
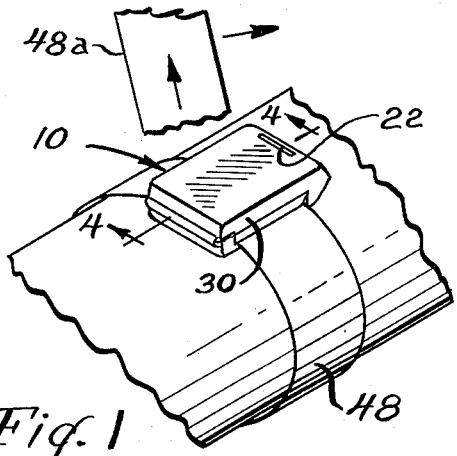
FIG. 1 is a fragmentary perspective view of an I. D. band and clip of this invention in the closed configuration, banded about a limb, showing excess tape being torn off.
Figure 2:
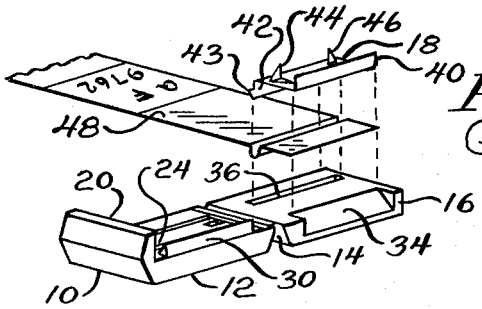
FIG. 2 is an exploded perspective view of the I. D. band clip of FIG. 1 in the open position.
Figure 3:
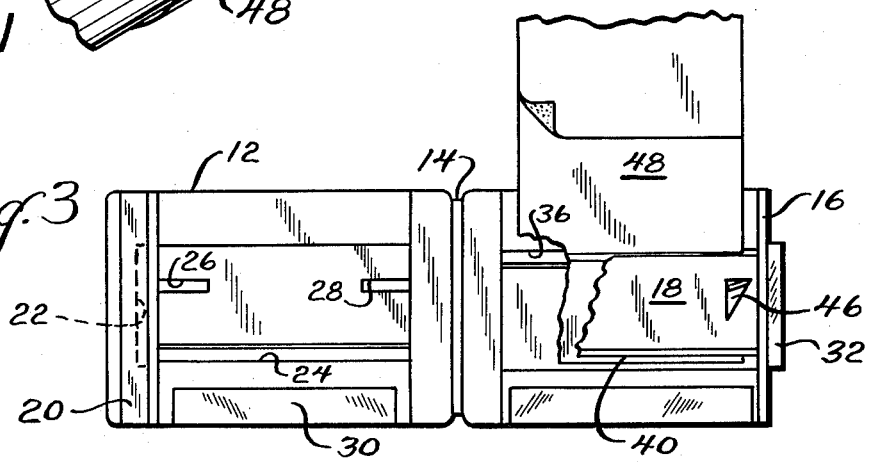
FIG. 3 is a plan view of the I. D. band clip of 2 having portions of the tape strip and retaining clip broken away.
Figure 4:
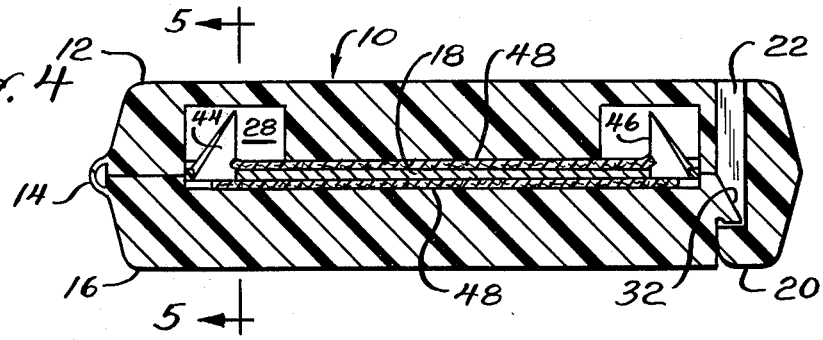
FIG. 4 is a cross-sectional view of the I. D. band clip of FIG. 1 taken along line 4—4 of FIG. 1.

Referring to the drawings, an I. D. band clip 10 is generally shown in FIG. 1 and FIG. 2 of the drawings. I. D. band clip 10 includes an upper arm 12 and a lower arm 16 connected by a hinge 14, formed integrally with arms 12, 16. A retaining member 18 of Z-shaped cross-section is positioned between upper arm 12 and lower arm 16 when clip 10 is closed.

Upper arm 12 may be composed of a plastic, and typically defines a generally rectangular configuration. Upper arm 12 includes a latching lip 20 formed integral with upper arm 12, opposite to hinge 14. A rectangular orifice 22 is formed immediately adjacent latching lip 20. An elongated slot 24 is positioned generally perpendicular to latching lip 20 and hinge 14 in upper arm 12. A pair of barb slots 26 and 28 are also formed in upper arm 12. A triangular guide bar 30 is formed as an integral part of upper arm 12 adjacent slot 24.

Hinge 14, as stated above, is integral with upper arm and lower arm 16, and is composed of an easily deformable plastic material. Lower arm 16 may be composed of the same plastic, and also may have a generally rectangular configuration. Lower arm 16 defines a triangular latching ear 32, formed integrally therewith and positioned opposite hinge 14. A ramp 34 is formed along the periphery of upper arm 16 between and at right angles to hinge 14 and latching ear 32, for cooperative engagement with guide bar 30, to assist in alignment of the tape strip after wrapping around the wrist.

An elongated edge slot 36 is formed in lower arm 16 between, and respectively perpendicular to, hinge 14 and triangular latching ear 32.

Z-shaped retaining plate 18 is typically composed of stamped sheet metal, preferably stainless steel. Retaining plate 18 defines a flat base 38. Edge strips 40, 42 are respectively bent in opposite directions at approximately a 90° angle, with respect to base 38, to form the Z-shaped configuration mentioned above.

Figure 5:
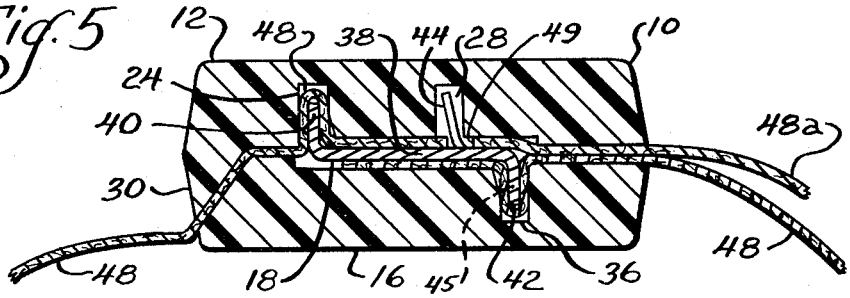
FIG. 5 is a cross-sectional view of the I. D. band clip of FIG. 4 taken along line 5—5 of FIG. 4.

As shown in FIG. 2, tape strip 48, for retention about a patient's wrist or ankle, overlies the inner face of upper arm 16. Tape strip 48 may be a laminate of paper and a biaxially-oriented polyethylene terephthalate sheet (for example sold under the brand name Mylar). Edge strip 42 of retaining member 18 is positioned within slot 36, forcing a length of the tape strip into the same slot in U-shaped configuration about edge strip 42 as shown in FIG. 5. Accordingly, the tape strip 48 is prevented from sliding with respect to clip 10 by frictional retention action between edge strip 42 and the material of arm 16 defining slot 36.

Edge strip 40 of retaining member 18 is adapted to enter slot 24 in similar manner, when clip 10 is closed, as shown in FIG. 5. Prior to closing of clip 10, a loop of tape 48 may be placed around the wrist or ankle of the patient, and then once again laid across the inner face of arm 16. Thereafter, as shown in FIG. 1, the arms of clip 10 may be brought together for closure, and the remaining portion of the tape removed.

As edge strip 40 penetrates into slot 24, it also pushes a portion of strip 48 into slot 24 about edge strip 40 in a U-shaped configuration, for additional retention of the strip with respect to clip 10.

Upon the closing of clip 10, latch ear 32 snaps into orifice 22, and is permanently retained there by latch lip 20. After closure, clip 10 cannot be reopened, except by forcing with tools or the like. Accordingly, an irrational patient will not be able to remove the clip and I. D. band of this invention, while clip 10, being made of plastic, will not be likely to cause the patient injury, because of the lack of sharp edges, in the event the patient makes an attempt to remove the I. D. band. Typically, the I. D. band can be removed by cutting the strip 48.

Edge strip 42 of retaining plate 18 defines a pair of triangular ears 43, 45 which are symmetrically positioned at opposite ends of edge strip 42, and serve to engage the ends of slot 36, for retention of retaining plate 18 while clip 10 is in the open position.

Retaining plate 18 also carries a pair of triangular barbs 44, 46 which pass into slots 26, 28 of arm 12 when the clip is in closed position. Upon closing of clip 10, barbs 44 and 46 cut notches into strip 48, which is laid between arms 12, 16 after looping around a patient's wrist or ankle. This forms a weak area 49 in strip 48, permitting a portion 48*a* of strip 48 to be separated by manual pulling, through breakage of the strip at weak area 49.

As described in the prior art, the severed portion 48*a* of the I.D. band strip 48 may be affixed to a sample container of the patient's blood, for futher reliable identification of the sample with the patient.

When and if tension is placed on the strip 48, for example by an irrational patient attempting to remove the I.D. band, it will be appreciated that edge strips 40 and 42 will tend to be deflected to press against one or the other walls of the respective slots 24, 36 in which they reside. This results in even greater application of frictional resistance to any pulling action on tape 48.

If desired latching lip 20 and latching ear 32 may be switched in their positions, to each be carried by the other arm of clip 10 from that shown herein.

The strip retention characteristics of the clip of this invention are not dependent upon adhesive, and are clearly superior to the retention characteristics of any device in which the frictional retention of facing, flat surfaces is relied upon.

The above has been offered for illustrative purposes only and is not for the purpose of limiting the invention of this application, which is as defined in the claims below.

That which is claimed is:

1. An identification band clip for use with a tape strip which comprises: a lower arm and an upper arm having inner faces and connected together by a hinge member to permit the arms to be initially in open position and to be moved into a closed, facing locked position; a retainng member adapted to be held between said lower and upper arms in said closed position, to frictionally grip lengths of said tape strip between said retaining member and said lower arm and also between said retaining member and said upper arm; in which the inner face of each said lower and upper arms defines a slot, and said retaining member defines first and second edge strips bent, relative to the remainder of said retaining member, in opposite directions, and a portion of tape strip overlying the inner face of said lower arm and wrapped around said first edge strip, said first edge strip and tape strip portion being retained within the slot of said lower arm, said second edge strip being positioned to pass into said slot of the upper arm when said lower and upper arms are brought into locked, facing relationship; and locking means for holding said upper and lower arms in said facing relationship.

2. The identification band clip of claim 1 in which said retaining member defines barb means positioned to penetrate the lateral portions of said tape strip, the inner face of said upper arm defining a pair of slots for receiving said barb means, for permitting and severing of excess tape after it has been wrapped around a body member of a patient, and said arms have been brought into facing, locked relationship.

3. The identification band clip of claim 2 in which said upper and lower arms, and said hinge, are composed of a plastic material.

4. The identification band clip of claim 3 in which said retainer member is a stamped metal sheet.

5. The identification band of claim 4 in which said tape strip is a laminate of paper and biaxially-oriented polyethylene terephthalate.

6. The identification band of claim 1 in which said locking means hold the upper and lower arms in said facing relationship, with a second portion of said tape strip being wrapped around said second edge strip, said second portion projecting into the slot of said upper arm along with said second edge strip.

* * * * *

UNITED STATES PATENT AND TRADEMARK OFFICE

CERTIFICATE OF CORRECTION

PATENT NO. : 3,983,604

DATED : October 5, 1976

INVENTOR(S) : Thomas E. Phillips

It is certified that error appears in the above-identified patent and that said Letters Patent are hereby corrected as shown below:

Column 4, line 31, delete "and" and insert therefor -- the --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*